US005996158A

United States Patent [19]

DeLorme et al.

[11] Patent Number: 5,996,158

[45] Date of Patent: Dec. 7, 1999

[54] CLEANING MODULE AND NOVEL CLEANING STUDS

[75] Inventors: Ronald William DeLorme, Magnolia; Peggy Lea Sims, Kemah; Joseph Lee Greene, Decatur, all of Tex.

[73] Assignee: Praxair Technology, Inc., Danbury, Conn.

[21] Appl. No.: 09/034,396

[22] Filed: Mar. 4, 1998

[51] Int. Cl.[6] ..... B08B 9/04

[52] U.S. Cl. ..... 15/104.061

[58] Field of Search ..... 15/104.061, 3.5, 15/104.05, 104.068, 104.069, 104.16, 186; 152/210; 305/180

[56] References Cited

U.S. PATENT DOCUMENTS

| | | | |
|---|---|---|---|
| 1,803,126 | 4/1931 | Oberhuber | 15/104.061 |
| 2,089,459 | 8/1937 | White | 152/210 X |
| 2,138,872 | 12/1938 | Marogg | 15/186 |
| 3,403,701 | 10/1968 | Knapp et al. | 15/104.061 X |
| 3,530,523 | 9/1970 | Ver Nooy | 15/104.061 |
| 3,573,985 | 4/1971 | Schultz | 134/8 |
| 3,838,894 | 10/1974 | Reedy | 152/210 X |
| 4,242,771 | 1/1981 | Knapp | 15/104.061 |
| 4,244,073 | 1/1981 | Sagawa | 15/104.061 |
| 4,406,031 | 9/1983 | Eimer et al. | 15/104.061 |
| 4,413,370 | 11/1983 | Payne et al. | 15/104.061 |
| 4,876,761 | 10/1989 | Sagawa | 15/104.061 |
| 5,035,021 | 7/1991 | Le Devehat | 15/104.061 |
| 5,150,493 | 9/1992 | Sivacoe | 15/104.061 |
| 5,157,803 | 10/1992 | Sagawa | 15/104.61 |
| 5,265,302 | 11/1993 | Sivacoe | 15/104.61 |
| 5,358,573 | 10/1994 | Sivacoe | 134/8 |
| 5,379,475 | 1/1995 | Sivacoe | 15/104.61 |
| 5,573,316 | 11/1996 | Wankowski | 305/180 |
| 5,607,513 | 3/1997 | Sims | 134/8 |
| 5,698,042 | 12/1997 | Sims et al. | 134/8 |

FOREIGN PATENT DOCUMENTS

| | | | |
|---|---|---|---|
| 57790/90 | 1/1991 | Australia . | |
| 63024 | 10/1982 | European Pat. Off. | 15/104.061 |
| 234072 | 9/1987 | European Pat. Off. . | |
| 372134 | 2/1907 | France | 152/210 |
| 55325 | 2/1891 | Germany | 15/104.16 |
| 2237346 | 2/1974 | Germany | 15/104.061 |
| 58-45831 | 10/1983 | Japan . | |
| 278318 | 11/1970 | Russian Federation . | |
| 913014 | 3/1982 | Russian Federation . | |
| 903689 | 2/1982 | U.S.S.R. | 15/104.061 |
| 622532 | 5/1949 | United Kingdom | 15/186 |
| 2229247 | 9/1990 | United Kingdom . | |
| 91/17843 | 11/1991 | WIPO | 15/104.16 |

OTHER PUBLICATIONS

Ura–Flex Manufacturing, Mar. 10, 1997.

*Primary Examiner*—Mark Spisich
*Attorney, Agent, or Firm*—Blake T. Biederman

[57] ABSTRACT

A module for use in a pipeline and a novel cleaning stud useable with the module. The module includes a body defining at least two cavities having certain dimensions, or defining a plurality of passages each for receiving a portion of one of the novel cleaning studs and defining at least one cavity within the body for providing a seating surface for engaging a lower catch on the stud.

19 Claims, 3 Drawing Sheets

CLEANING MODULE AND NOVEL CLEANING STUDS

FIELD OF THE INVENTION

This invention relates to modules for cleaning piping systems and more particularly to cleaning studs which interlock with the body of the module.

BACKGROUND OF THE INVENTION

Piping systems including fired heaters in process plants accumulate deposits which are difficult, time consuming, and expensive to remove. Hydrocarbon-based process fluids are heated in fired heaters to temperatures at which carbon tends to bake onto the pipe walls in extremely hard deposits. These deposits choke down the pipe diameter, requiring extra pumping effort. They also create an undesirable insulation effect in heat transfer equipment and fired heaters. The extra energy required to overcome these resistances to heat transfer and flow increases process costs and can lead to equipment damage and piping rupture. The cleaning process is generally complicated by numerous bends, valves, manifolds, diameter changes, and other variations in the pipe layout.

Fired heaters are often constructed with plugged headers at regular intervals. These plugged headers join parallel sections of straight pipe to create a serpentine flow path as described in U.S. Pat. No. 5,698,042 by Sims et al. which discloses a specially-dimensioned cleaning module, also referred to as a pig, for traversing plugged headers. Within the plugged headers, the cross sectional shape of the pipe typically changes from round to rectangular or oval and back to round.

Any technique for cleaning these piping systems and fired heater systems must have the ability to remove the deposit from varying geometries, maintain its integrity as it travels and conforms to the changes, yet leave the pipe walls undamaged. Any cleaning efficiencies that can be gained in terms of speed, cost, or effectiveness are advantageous.

The practice of using pigs in pipelines to separate or displace products is well established. Likewise there are a wide variety of devices to clean straight runs of pipe. It is only recently that pigs have been developed to clean hard deposits from piping systems containing multiple direction changes, diameter changes, and other variations in pipe geometry. U.S. Pat. No. 5,265,302 by Sivacoe, for example, shows a cylindrical, low-density polymer-based pig with molded-in receptacles having cleaning studs which are screwed into the receptacles. The molding of a Sivacoe pig requires a complicated and time-consuming positioning of numerous receptacles within the mold prior to forming the pig. After the pig body is formed, further time is expended when the pig is assembled by threading each stud into one of the receptacles. The receptacles create voids which weaken the structure of the pig so that the pig has a tendency to separate along lines from receptacle to receptacle. The size and therefore holding power of the receptacles is limited by the voids or discontinuities that they create in the pig body. As the receptacles are made larger and therefore closer together, the tendency for separation increases. When the pig is subjected to the loads of cleaning, these receptacles are sometimes pulled entirely out of the pig body.

Other methods of attaching cleaning studs are described in U.S. Pat. No. 4,244,073 by Sagawa in which a barb is pressed into a foam bodied pig, or U.S. Pat. No. 4,242,771 by Knapp in which a foam body is cast directly around the stud. In both of these cases, the holding power of the cleaning studs is limited by the low resistance of the foam body.

Sivacoe discloses one type of hollow end in U.S. Pat. Nos. 5,265,302 and 5,358,573 which are flared and extend into the pig by only a moderate distance. The primary structure of the Sivacoe pig is a solid cylindrical body. Another pig having a more pronounced hollow end is the Uraflex III pig available from Ura-Flex Manufacturing, Granbury, Tex. The hollow ends are not designed to support or engage a cleaning stud according to the present invention. Instead, the intent of the Sivacoe and Ura-Flex hollow ends is to provide a sealing action for the pig when it is hydraulically driven.

A pig designed to clean fired heaters or complicated piping systems must have sufficient flexibility to negotiate short radius bends, manifolds and headers. It must also have sufficient stiffness to apply a cleaning force against the pipe walls. Existing cleaning pigs are typically cast in a single spherical or cylindrical form. The flexibility of these pigs is typically adjusted by varying the density of the material of construction such as a polyurethane foam. Conventional understanding dictates that a solid cylindrical or spherical pig formed from a solid (non-foam) elastomer such as polyurethane would be too stiff and would not be economic due to the amount of material used. Knapp in U.S. Pat. No. 4,242,771, column 3, lines 27–30 states that "Foam densities in the range of 10–20 pounds per cubic foot are ordinarily acceptable. Higher densities . . . increase cost to an unacceptable level."

OBJECTS OF THE INVENTION

It is therefore an object of the invention to provide an improved cleaning module which is versatile, durable and economical.

It is a further object of this invention to provide such a cleaning module which readily enables assembly of a body with cleaning studs that are appropriate for a selected task.

Yet another object of the invention is to provide improved cleaning studs with a novel mechanism for interlocking with a body of a cleaning module.

A still further object of the invention is to provide a novel insertion tool facilitating insertion of the improved cleaning studs into the body of the cleaning module.

SUMMARY OF THE INVENTION

This invention comprises a module for cleaning the inner surface of a pipeline and a novel cleaning stud for use with the module. The module includes a body defining a plurality of passages each for receiving a portion of one of the novel cleaning studs, and defining at least one cavity within the body for providing a seating surface for engaging a lower catch on the stud.

In one embodiment the body is substantially cylindrical and defines two cavities separated from each other by a center web within the body. The body preferably is fabricated from a non-foam elastomer such as polyurethane having a Shore A durometer of between 55 and 80 and a material density between 60 and 100 $lb/ft^3$ (960 and 1600 $kg/m^3$). More preferably, the body defines at least two rows of stud passages which are offset from each other to stagger the cleaning studs about the exterior of the body.

This invention further features a non-spherical module for use in a pipeline, comprising a body having a root diameter and a body length, and defining a cavity at each end, each cavity having a hydraulic diameter that is at least ⅜ of the root diameter, one cavity having a length that is at least ⅓ of the body length and the other cavity having a length that is at least ⅕ of the body length. Preferably, each cavity has a substantially uniform hydraulic diameter along its entire length.

This invention also features a cleaning stud for use with a body of a cleaning module, the stud having a head attached to one end of a shank, an upper shoulder adjacent to the head of the shank for engaging an exterior portion of the body, and a lower catch attached to another end of the shank for engaging an inner seating surface of the body.

In a preferred embodiment, the shoulder of the stud has a disk-like surface for engaging the exterior portion of the body, and the catch has a disk-like surface for engaging the inner seating surface of the body. Preferably, the catch further includes an outer surface, facing away from the disk-like surface, for engaging an insertion tool. More preferably, the outer surface defines one of a detent and a recess for releasably interlocking with the insertion tool, and the tool defines one of a recess and a detent for releasably interlocking with the stud. The tool has a substantially conical insertion surface for slidably engaging a stud passage in the body to assist insertion of the stud into the passage.

BRIEF DESCRIPTION OF THE DRAWING(S)

Other objects, features and advantages will occur to those skilled in the art from the following description of preferred embodiments and the accompanying drawing, in which.

DETAILED DESCRIPTION OF THE INVENTION

Figure 1:
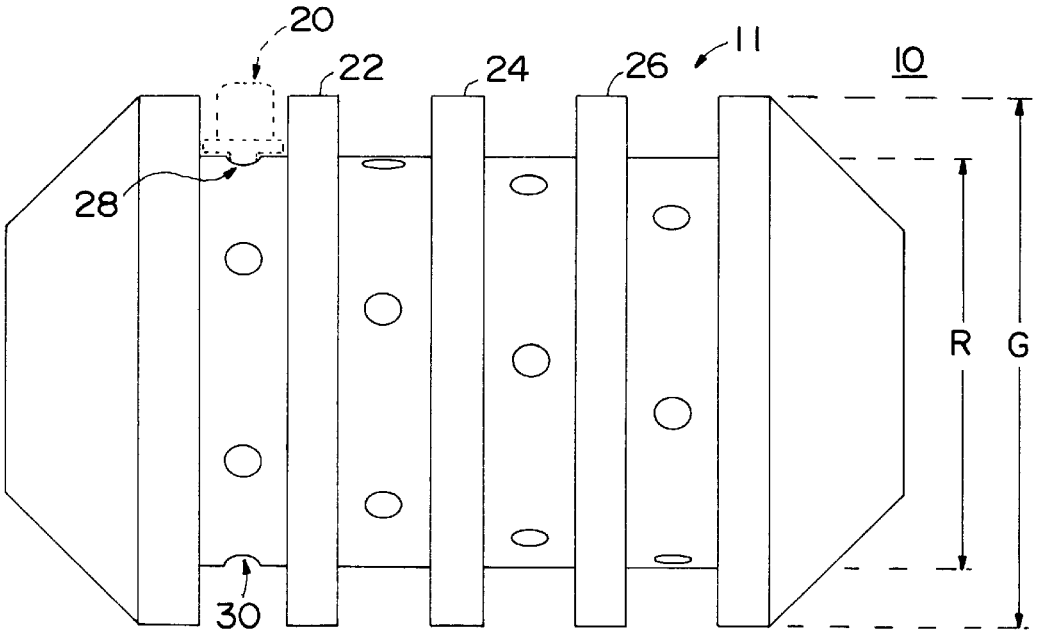
FIG. 1 is a schematic side view of a cleaning module of the invention.
Figure 2:
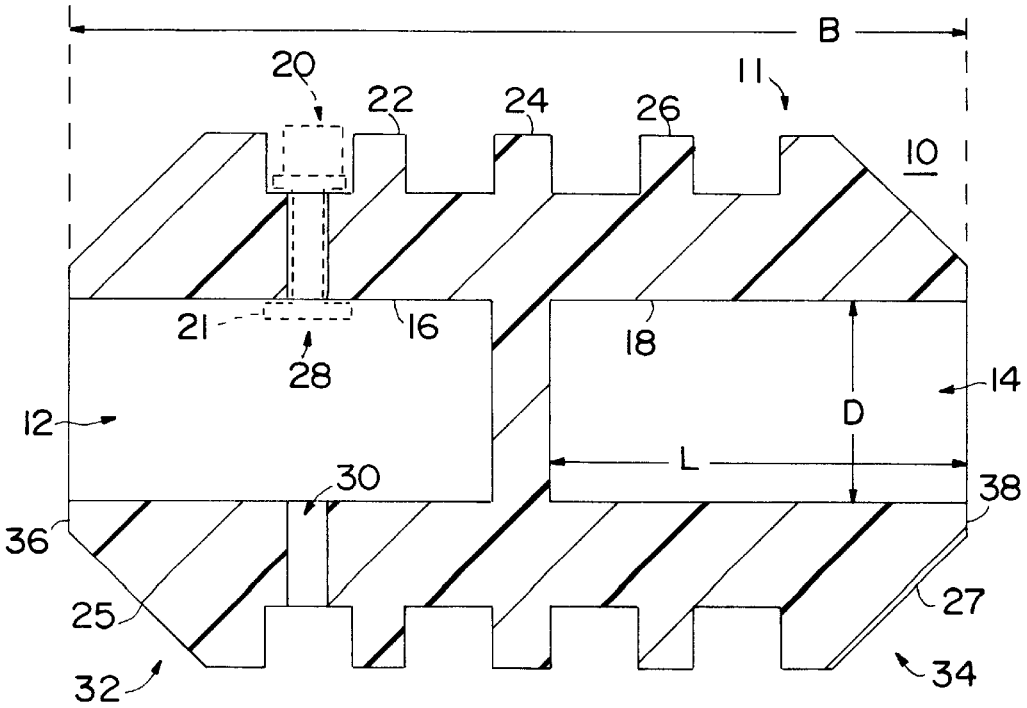
FIG. 2 is a cross-sectional view of FIG. 1.

A cleaning module 10, FIGS. 1 and 2, also referred to as a pig, according to the present invention is formed of a generally cylindrical body 11. A cavity 12, 14, FIG. 2, preferably is formed at each end of the body 11 to lighten the pig, reduce material costs, and improve its flexibility. When constructed to be used with cleaning studs, each cavity 12, 14 also provides an inner seating surface to receive a lower catch of cleaning studs according to the present invention. A stud 20 having a catch 21 is shown in phantom in FIGS. 1 and 2 and is described in more detail below.

Preferably the body is cast with ribs 22, 24, 26 as shown in FIGS. 1 and 2 to provide partial sealing against an inner surface of a pipe to lessen the amount of driving fluid that bypasses around the body of the pig when it is hydraulically driven by the fluid. Sloping surfaces 25, 27 of noses 32, 34 tapering to tips 36, 38 are preferred to assist travel of the module 10 through a pipeline. Stud passages such as holes 28, 30 are drilled or cast through the pig body into the cavities 12, 14 to receive the cleaning studs.

Figure 6:
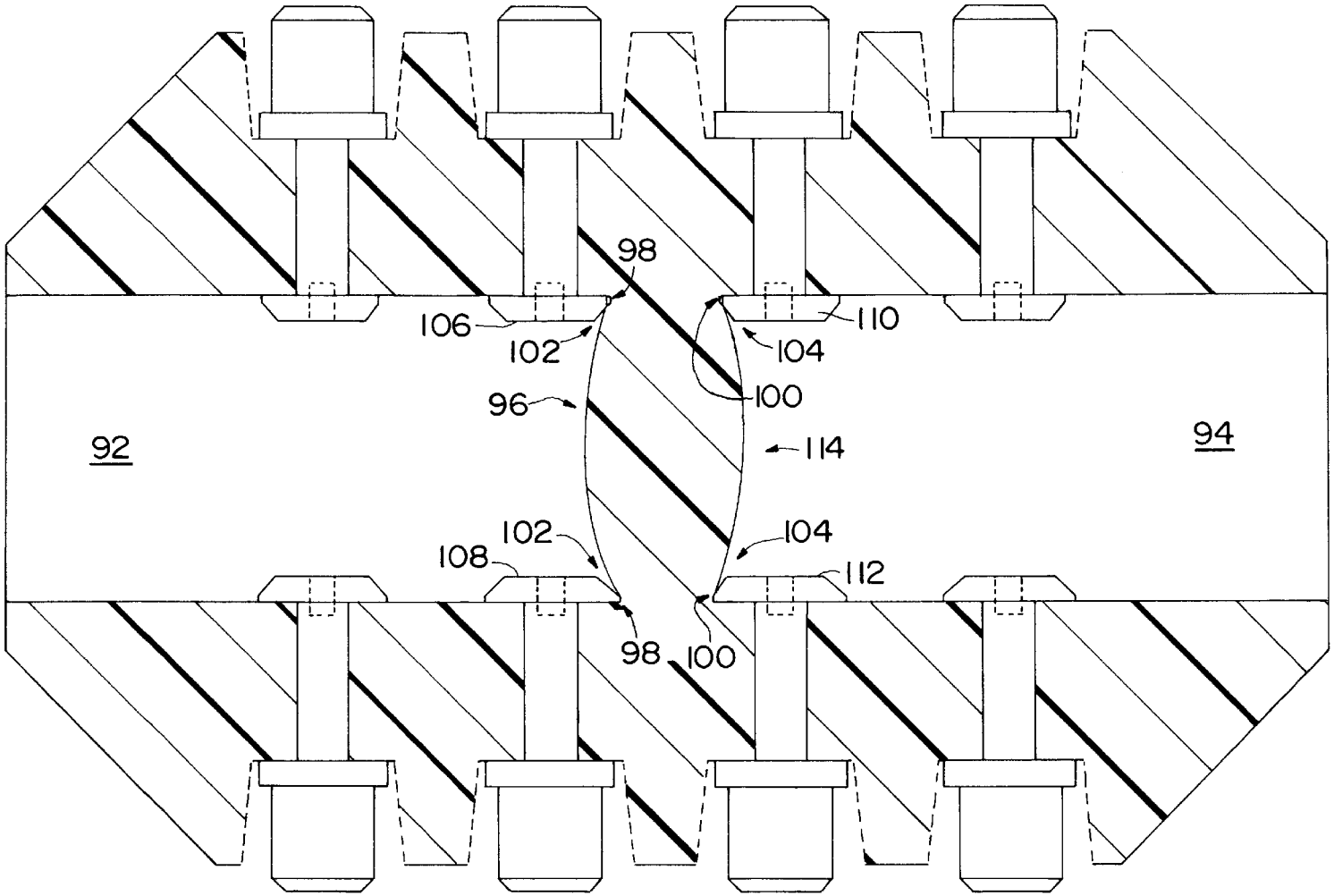
FIG. 6 is a cross-sectional view similar to FIG. 2 showing a convex web.

When constructed to separate two fluids, such as gasoline and diesel fuel, or to clear a pipeline by pushing a fluid out of the line, stud passages may be omitted. It is preferable for each cavity 12, 14 to have a hydraulic diameter D that is at least ⅜, more preferably at least ½, and preferably equal to or less than ¾, of the root diameter R of module body 11. Preferably, at least one cavity has a length L that is at least ⅓ of the body length B and the other cavity has a length L that is at least ⅕ of the body length B. More preferably, the length L of each cavity is at least ⅓, most preferably at least ⅜, of the body length B. The hydraulic diameter is defined as (4)(area/perimeter) of the cavity. Preferably, body 11 is formed of a non-foam elastomer as described in more detail below, has a ratio of overall length B to greatest diameter G of about 1.5 to about 1.75, and has; a nose tapered to a tip located at each end of the body with a ratio of overall length to nose length of about 5 to about 10 as shown in FIG. 6.

Figures 3, 4, 5:
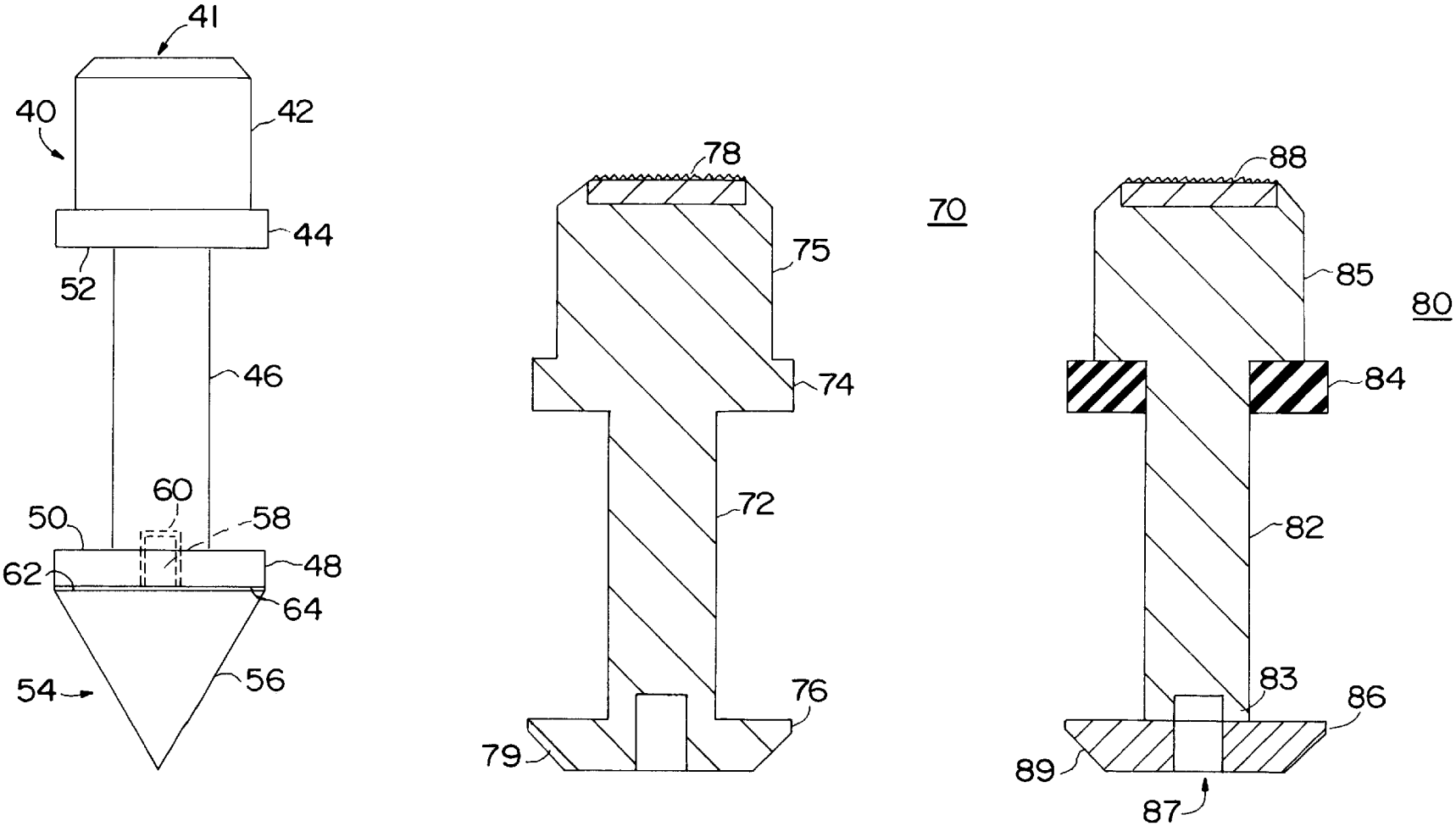
FIG. 3 is a schematic side view of a cleaning stud of the invention and a removable insertion tool.
FIG. 4 is a schematic cross-sectional view of another construction of a unitary cleaning stud of the invention having a beveled catch.
FIG. 5 is a schematic cross-sectional view of yet another construction of a multi-part stud having a separate shoulder.

In a preferred construction the cleaning stud 40, FIG. 3, is comprised of a head 42, an upper shoulder 44, a shank 46, and a lower catch 48. The head 42 includes a receptacle 41 for holding a cleaning insert as described below. The stud is installed so that surface 50 of the lower catch 48 engages a seating surface within a cavity of the pig, surface 52 of the upper shoulder 44 engages an exterior portion on the outer surface of the pig, and the shank 46 engages the wall of the stud passage through-hole.

To join a stud and a pig body, the stud is pressed into the stud passage using a conical tool 54 having an individual surface 56 to stretch the pig body around the catch 48; the pig body then returns to its original shape to trap the stud in position. Tool 54 has a detent 58 which is inserted into corresponding recess 60 in this construction so that tool surface 62 engages catch surface 64.

The studs preferably are radially oriented in rows around the pig with at least one row at each end of the pig. The stud passages are offset so that all studs are equally spaced around the circumference of the pig when viewed from either end. Preferably, each stud tip overlaps slightly the adjacent tips when viewed from the end.

Pig bodies structured according to the present invention permit each stud to be manufactured as a single part which is quickly pressed into the pig body. The pigs can be assembled rapidly and economically with studs having desired cleaning surfaces selected for a particular cleaning situation. The pig body molds are simple in nature, eliminating the parts and labor required for positioning of receptacles. The catch and shoulder at the end of the cleaning studs can be larger than conventional embedded receptacles to the point of nearly touching adjacent catches within a cavity because they do not create individual voids in the pig body. The larger diameter provides a more secure anchoring mechanism. The through holes are smaller because the shank does not require a thread form, therefore the through holes create smaller discontinuities in the pig structure and lesser tendencies for separation. The cavities at the ends of the pig reduce the amount of material used, thereby generating a cost savings. These features result in a stronger pig that requires fewer manufacturing materials and operations, thereby providing further cost savings.

The pig body of the present invention preferably is manufactured from a non-foam elastomer such as polyurethane having a Shore A durometer of between 55 and 80, preferably 65 to 70. The density of solid polyurethane is on the order of 60 to 100 lb/ft.$^3$ (960 to 1600 kg/m$^3$) preferably 80 lb/ft.$^3$ (1280 kg/M$^3$). By comparison, to the best of the inventors' knowledge, the highest foam density of a conventional pig is on the order of 40 lb/cu ft. The denser material used according to the present invention resists local deflection and further enhances anchoring of the cleaning studs. At the same time, the cavities permit the overall pig shape to distort as necessary to negotiate elbows and pipe diameter reductions. Other pig body shapes, such as spheres or polyhedrons, may also be utilized.

A preferred embodiment of the exterior of a pig according to the present invention would conform to U.S. Pat. No. 5,698,042 by Sims et al., which is incorporated herein by reference, and is shown in FIG. 6. The cavity 92, 94 diameter ranges from ¾ inch to 4½ inches (19 mm to 114 mm). The web 96 at the center of the pig must be thick enough to withstand the driving pressure of the pig but is limited because the overall length of the pig is a fixed ratio of the diameter as disclosed in the above mentioned patent and web thickness increases reduce the number of stud rows. The web thickness varies from ½ inch to 1½ inch (13 mm to 38 mm). The preferred design has a convex web 96 with a clearance ring-shaped indentation 98, 100 as shown in FIG. 6. The reduced thickness portion 102, 104 of the web 96 permits clearance for the catches 106, 108, 110, 112 while convex area 114 of the web 96 provides increased resistance to driving fluid pressure. This design permits clearance for the catches of the cleaning studs while providing increased thickness of the web for resistance to driving pressure. Typical concavity dimensions for the web are 1½ inch thick at the wall and 2.1 inches at the center on an eight inch pig. The web may be offset from one end of the pig to permit an additional row of cleaning pins. In smaller pig sizes, interference between lower catches can be relieved slightly by cutting a forty five degree bevel at the bottom edge of the lower catches as shown in FIGS. 4 and 5.

The cleaning of tubes is carried out by methods well known in the trade or by methods outlined in U.S. Pat. No. 5,607,513 by Peggy Sims, which is incorporated herein by reference. No special procedures are required for pigs according to the present invention.

The studs preferably are machined from a grade of carbon steel stock which is easily machineable, heat-treatable, and permits silver brazing of tip inserts. An acceptable material is a turning stock grade known as STRESSPROOF, which is a registered trademark of La Salle Steel and commonly available from suppliers such as Bethlehem Steel under the designation C1144. The dimensional information that follows are for pigs with outside body diameters of from 2 to 8 inches. The lower catch diameter of the cleaning pins ranges from ½ to 0.70 inches (13 mm to 18 mm). The shank diameter ranges from 3/16 to 5/16 inch (4.7 mm to 8 mm). The thickness of the catch is ⅛ inch (3.2 mm). The upper shoulder and lower catch diameters typically are equivalent to each other on a given pig. The height of the tip portion of the studs is set so that the tip of the stud is ⅛ inch above the pig body. Each stud has a small ⅛ inch recess drilled at its base which permits temporary interlocking with an insertion tool as shown in FIG. 3. The pig is laid in a fixture which defines a holding trough. The pig is held with the conical insertion tool at the entrance to a stud passage. Pressure is applied to the stud using an arbor press. The insertion tool is separated by gravity and drops into the cavity of the pig and is reused for subsequent pin insertions. Another tool comprising a cylindrical sleeve closed at one end to form a socket preferably is slipped over the head and engages the upper shoulder. When the arbor press applies insertion pressure, this sleeve protects the head and provide a stable surface to apply force against the stud.

The pins could be formed with an integral insertion tool, however this creates interference at the center of the pig when there are a large number of studs. The shank 72, shoulder 74 and catch 76 of stud 70 preferably are manufactured and installed as a single part as shown in FIG. 4. In other construction the head 75 is integral or made of a different material and attached to the shoulder. Alternatively, the stud is manufactured out of two parts inserted from either end of the stud passage and fastened together such as a bolt and nut.

Yet another stud construction is shown in FIG. 5 for stud 80. Shank 82 and head 85 are formed from one piece while catch 86 is machined or cast separately and then welded or brazed to shaft end 83 after a polymeric ring 84, such as a TEFLON polymer washer, is slipped upwardly past shaft end 83 to seat against the underside of head 85. Recess 87 is defined within catch 86 and, if additional depth is necessary, within shaft end 83 as shown in FIG. 5.

Catches 76, 86 are shown with beveled edges 79, 89 to assist insertion into a stud passage and to enable use of a smaller-diameter insertion tool. These bevels also reduce interference among the catches, 76 and 86 of adjacent studs when the pig deforms as it passes obstruction S. Catches 76, 86 preferably are disk-like, circular pieces but can be formed as other geometric shapes such as rectangles or ovals.

Low cost cleaning inserts 78, 88, FIGS. 4 and 5, for cleaning deposits of moderate hardness, are machined integrally with heads 75, 85 and are heat treated to Rockwell C 45–50 to increase wear resistance. Inserts for more aggressive cleaning have brazed-in tungsten carbide inserts. One variation uses serrated waffle-style tips of tungsten carbide which are commonly used for robotics holding fingers. Tungsten material can be sprayed on tip surfaces for longer wear by common techniques in the industry. For removing soft deposits, the entire stud can be made of a non-metallic material such as nylon or other polymeric material.

Specific features of the invention are shown in one or more of the drawings for convenience only, as each feature may be combined with other features in accordance with the invention. Alternative embodiments will be recognized by those skilled in the art and are intended to be included within the scope of the claims.

What is claimed is:

1. A module for cleaning the inner surface of a pipeline, comprising a body and a plurality of pipe cleaning studs, each stud having a head attached to one end of a shank, an upper shoulder adjacent to said head for engaging an exterior portion of said body, and a lower catch attached to another end of said shank for engaging a seating surface of said body; and said body being substantially cylindrical and defining a plurality of passages each for receiving said shank of said cleaning studs, and defining at least one cavity within the body for providing said seating surface for engaging said lower catch on said studs.

2. The module of claim 1 wherein said body has a root diameter and a body length, and said body includes said cavity at each end thereof, each said cavity having a hydraulic diameter that is at least ⅜ of the root diameter, one said cavity having a length that is at least ⅓ of the body length and the other said cavity having a length that is at least ⅕ of the body length.

3. The module of claim 2 wherein the length of each said cavity is at least ⅓ of the body length, and the hydraulic diameter is substantially uniform along the entire length of each said cavity.

4. The module of claim 2 wherein said hydraulic diameter of each said cavity is equal to or less than ¾ of the root diameter.

5. The module of claim 1 wherein said body is fabricated from a non-foam elastomer.

6. The module of claim 5 wherein said elastomer is polyurethane.

7. The module of claim 5 wherein said elastomer has a Shore A durometer of between 55 and 80 and a material density between 60 and 100 $lb/ft^3$ (960 and 1600 $kg/m^3$).

8. The module of claim 1 wherein said body defines at least two rows of passages which are offset from each other to stagger the cleaning studs about the exterior of said body.

9. A module for cleaning the inner surface of a pipeline, comprising:

a plurality of cleaning studs, each stud having a head attached to one end of a shank, an upper shoulder adjacent to said head, and a lower catch attached to another end of said shank; and a substantially cylindrical body defining a plurality of passages each for receiving said shank of one of said cleaning studs, each passage having an exterior portion and an interior portion, said exterior portion of said passage being surrounded by an exterior portion of said body for engaging said shoulder of one of said cleaning studs, said body further defining at least two cavities within the body communicating with the interior portion of each said passage and separated from each other by a center web within said body, each said cavity providing a seating surface for engaging said lower catch on each said stud.

10. The module of claim 9 wherein said body is fabricated from a non-foam polyurethane.

11. The module of claim 10 wherein said polyurethane has with a Shore A durometer of between 55 and 80 and a material density between 60 and 100 $lb/ft^3$ (960 and 1600 $kg/m^3$).

12. The module of claim 11 wherein said body defines at least two rows of passages which are offset from each other to stagger the cleaning studs about the exterior of said body.

13. The module of claim 9 wherein said body has a root diameter and a body length, and said body includes one of said cavities at each end thereof, each said cavity having a hydraulic diameter that is at least ⅜ of the root diameter, one said cavity having a length that is at least ⅓ of the body length and the other said cavity having a length that is at least ⅕ of the body length.

14. The module of claim 13 wherein the length of each said cavity is at least ⅓ of the body length, and the hydraulic diameter is substantially uniform along the entire length of each said cavity.

15. The module of claim 13 wherein the hydraulic diameter of each said cavity is equal to or less than ¾ of the root diameter.

16. The cleaning stud of claim 9 wherein said shoulder has a disk-like surface for engaging the exterior portion of the body, and wherein said catch has a disk-like surface for engaging the inner seating surface of the body.

17. The cleaning stud of claim 16 wherein said catch further includes an outer surface, facing away from said disk-like surface, for engaging an insertion tool; and said outer surface defines one of a detent and a recess for releasably interlocking with the insertion tool.

18. The cleaning stud of claim 17 further including the insertion tool, said tool defining one of a recess and a detent for releasably interlocking with said stud.

19. The cleaning stud and tool of claim 18 wherein said tool has a substantially conical insertion surface for slidably engaging a stud passage in the body.

* * * * *